US012624559B2

(12) United States Patent
Horie

(10) Patent No.: US 12,624,559 B2
(45) Date of Patent: May 12, 2026

(54) STAKE CLIPS AND CONCRETE FORMING SYSTEMS INCORPORATING THE SAME

(71) Applicant: Fukuvi USA, Inc., Huber Heights, OH (US)

(72) Inventor: Hironori Horie, Tokyo (JP)

(73) Assignee: Fukuvi USA, Inc., Huber Heights, OH (US)

( * ) Notice: Subject to any disclaimer, the term of this patent is extended or adjusted under 35 U.S.C. 154(b) by 165 days.

(21) Appl. No.: 18/746,958

(22) Filed: Jun. 18, 2024

(65) Prior Publication Data

US 2024/0426115 A1 Dec. 26, 2024

Related U.S. Application Data

(60) Provisional application No. 63/511,226, filed on Jun. 30, 2023, provisional application No. 63/509,086, filed on Jun. 20, 2023.

(51) Int. Cl.
*E04G 17/14* (2006.01)

(52) U.S. Cl.
CPC ..... *E04G 17/14* (2013.01)

(58) Field of Classification Search
CPC ..... E04G 17/14; E04G 13/00; E04G 17/00; E04G 9/08; E01C 19/502
See application file for complete search history.

(56) References Cited

U.S. PATENT DOCUMENTS 1,473,730 A * 11/1923 Loxterman ..... E01C 19/502 249/7
2,663,925 A * 12/1953 Yates ..... E04G 13/00 249/7
2,846,749 A * 8/1958 Yates ..... E01C 19/502 249/7
4,340,200 A * 7/1982 Stegmeier ..... E04G 13/00 249/168

(Continued)

OTHER PUBLICATIONS

"4-Inch Plastic Concrete Form Tryout Package" https://plastiform.com/product/4-inch-tryout-package/ Accessed/Published Date: 2019.

(Continued)

*Primary Examiner* — Gisele D Ford
(74) *Attorney, Agent, or Firm* — Dinsmore & Shohl LLP

(57) ABSTRACT

A stake clip may comprise a form board insertion plate; a compression arm comprising at least one stake anchoring position and a locking slot extending through the compression arm; a compression arm joint connecting the compression arm to the form board insertion plate, the compression arm configured to pivot about the compression arm joint through a locking slot travel arc; a locking arm comprising a locking tip and a plurality of locking projections; and a locking arm joint connecting the locking arm to the form board insertion plate, the locking arm configured to pivot about the locking arm joint through a locking tip travel arc, and wherein: the locking slot travel arc of the compression arm and the locking tip travel arc of the locking arm overlap at a clip engagement point, and the locking arm is spring- (Continued)

biased in a direction of the locking projections, such that the locking slot is configured to catch on the plurality of locking projections as the locking arm passes through the locking slot.

20 Claims, 10 Drawing Sheets

(56) References Cited

U.S. PATENT DOCUMENTS

| | | | | |
|---|---|---|---|---|
| 5,154,837 | A * | 10/1992 | Jones | E04G 9/08 249/7 |
| 5,261,635 | A * | 11/1993 | Flathau | B28B 23/00 249/7 |
| 6,629,681 | B1 * | 10/2003 | Miller | E04G 17/04 249/7 |
| 10,385,576 | B2 | 8/2019 | Ciuperca | |
| 2008/0099657 | A1 * | 5/2008 | Miller | E04G 13/06 249/8 |

OTHER PUBLICATIONS

"Plastiform—Camlock Clamp" https://concretecountertopsolutions.com/products/plastiform-camlock-clamp Accessed/Published Date: 2024.

Plastiform—Plastic Form Boardshttps://concretecountertopsolutions.com/products/plastiform-plastic-form-boards?variant=40304025600188&currency=USD&utm_source=google&utm_medium=cpc&utm_campaign=google%2Bshopping&tw_source=google&tw_adid=&tw_campaign=17889738674&gad_source=1&gclid=Cj0KCQjwj4K5BhDYARIsAD1Ly2qUBYOk4OHfuFtXc8fY0HjRPPiEDg-OCZAK0rsmnaYcN0d4syJ32eQaAs0zEALw_wcB.

* cited by examiner

STAKE CLIPS AND CONCRETE FORMING SYSTEMS INCORPORATING THE SAME

CROSS-REFERENCE TO RELATED APPLICATIONS

This application claims the benefit of and priority to U.S. Application Ser. No. 63/509,086 filed Jun. 20, 2023, as well as U.S. Application Ser. No. 63/511,226 filed Jun. 30, 2023, the entire contents of which are incorporated by reference in the present disclosure.

FIELD

The present disclosure generally relates to pouring and forming concrete. Particularly, embodiments herein may be generally directed to devices and systems for forming concrete when pouring concrete, such as but not limited to stake clips for securing a stake to a form board for the concrete forming system.

BACKGROUND

When pouring concrete, form boards may be utilized to support the concrete pour from the sides and thereby form the concrete by providing it with the desired geometry. To secure the form boards in place, stakes may be driven into the ground and the form boards may be attached to the stakes to thereby secure the form boards in the desired position. Thereafter, concrete may be poured into the area defined within the form boards.

SUMMARY

Accordingly, methods, systems and devices may be desired by which form boards may be attached to the stakes. Furthermore, such systems and devices may be desired to be easily removable and/or adjustable to conform to a variety of stake sizes and shapes. Consequently, provided herein may be stake clips that may be utilized to secure a form board to a stake.

In one embodiment, a stake clip may comprise a form board insertion plate; a compression arm comprising at least one stake anchoring position and a locking slot extending through the compression arm; a compression arm joint connecting the compression arm to the form board insertion plate, the compression arm configured to pivot about the compression arm joint through a locking slot travel arc; a locking arm comprising a locking tip and a plurality of locking projections; and a locking arm joint connecting the locking arm to the form board insertion plate, the locking arm configured to pivot about the locking arm joint through a locking tip travel arc, and wherein: the locking slot travel arc of the compression arm and the locking tip travel arc of the locking arm overlap at a clip engagement point, and the locking arm is spring-biased in a direction of the locking projections, such that the locking slot is configured to catch on the plurality of locking projections as the locking arm passes through the locking slot.

In another embodiment, a stake clip may comprise a form board insertion plate comprising a form facing face and an opposite stake facing face; a compression arm comprising a handling face, an opposite stake anchoring face, and a locking slot extending through the compression arm at a distal portion of the compression arm, wherein the stake anchoring face comprises at least one stake anchoring position extending into the stake anchoring face; a compression arm joint connecting a proximal portion of the compression arm to the form board insertion plate, the compression arm configured to pivot about the compression arm joint through a locking slot travel arc; a locking arm comprising a locking face, a locking tip, and a plurality of locking projections extending from the locking face; and a locking arm joint connecting a proximal portion of the locking arm to the form board insertion plate, the locking arm configured to pivot about the locking arm joint through a locking tip travel arc.

In at least the previous embodiment, the locking arm joint and the compression arm joint may be spaced apart from each other along a longitudinal dimension of the form board insertion plate, the locking slot travel arc of the compression arm and the locking tip travel arc of the locking arm may overlap at a clip engagement point to enable the locking tip and a portion of the locking arm comprising the locking projections to pass through the locking slot of the compression arm, and the locking arm may be spring-biased in a direction of the locking projections along a portion of the locking tip travel arc that comprises the clip engagement point, such that the locking slot is configured to catch on the plurality of locking projections as the locking arm passes through the locking slot.

In yet another embodiment, a stake clip may comprise a form board insertion plate comprising a form facing face, an opposite stake facing face, and a locking arm stop that protrudes from the stake facing face; a compression arm comprising a handling face, an opposite stake anchoring face, and a locking slot extending through the compression arm at a distal portion of the compression arm, wherein the stake anchoring face comprises a plurality of stake anchoring positions (522/524/526) extending into the stake anchoring face and a plurality of protrusions corresponding to the plurality of stake anchoring positions, each of the plurality of stake anchoring positions comprising a distinct radius of curvature; a compression arm joint connecting a proximal portion of the compression arm to the form board insertion plate, the compression arm configured to pivot about the compression arm joint through a locking slot travel arc, and wherein the radius of curvature of the stake anchoring positions increases as a function of distance from the compression arm joint measured along the compression arm; a locking arm comprising a locking face, an opposite bumper face, a bumper protruding from the bumper face, a locking tip, and a plurality of locking projections (542) extending from the locking face; and a locking arm joint connecting a proximal portion of the locking arm to the form board insertion plate, the locking arm configured to pivot about the locking arm joint through a locking tip travel arc, the locking arm stop defining a maximum pivot angle of the locking arm through the locking tip travel arc.

In at least the previous embodiment, the locking arm joint and the compression arm joint may be spaced apart from each other along a longitudinal dimension of the form board insertion plate, the locking slot travel arc of the compression arm and the locking tip travel arc of the locking arm may overlap at a clip engagement point to enable the locking tip and a portion of the locking arm comprising the locking projections to pass through the locking slot of the compression arm, the locking arm may be spring-biased in a direction of the locking projections along a portion of the locking tip travel arc that comprises the clip engagement point, such that the locking slot is configured to catch on the plurality of locking projections as the compression arm passes through the locking slot, the bumper may be configured to contact the locking arm stop at the maximum pivot angle of the locking arm, and the bumper may be configured to provide an additional bias on the locking arm in the direction of the locking projections when the locking arm stop contacts the bumper.

BRIEF DESCRIPTION OF THE SEVERAL VIEWS OF THE DRAWINGS

The following detailed description of specific embodiments of the present disclosure can be best understood when read in conjunction with the following drawings, where like structure may be indicated with like reference numerals and in which.

DETAILED DESCRIPTION

As previously stated, embodiments herein are generally directed to concrete forming systems, and particularly to stake clips, such as stake clips for securing a stake to a form board for the concrete forming system.

As used herein, the term "connected", or any grammatical variations thereof, used with respect to two or more components, should not be used to create an inference that the two or more components are directly connected. Rather, an intervening component(s) may or may not be placed between the two components, such that the two "connected" components may be indirectly connected as facilitated by the intervening component(s).

As used herein, the term "proximal" means closer to or in the direction of an origin of an element, such as an arm as described herein. The origin of an arm may be the pivot point of said arm, or where the arm connects to the component operable to induce the pivot, such as the joints described herein. The term "distal" in contrast means further from the aforementioned origin, such as nearer to the tip of the arm defining the maximum length of the arm, as may be understood by the descriptions and figures herein.

Figure 1:
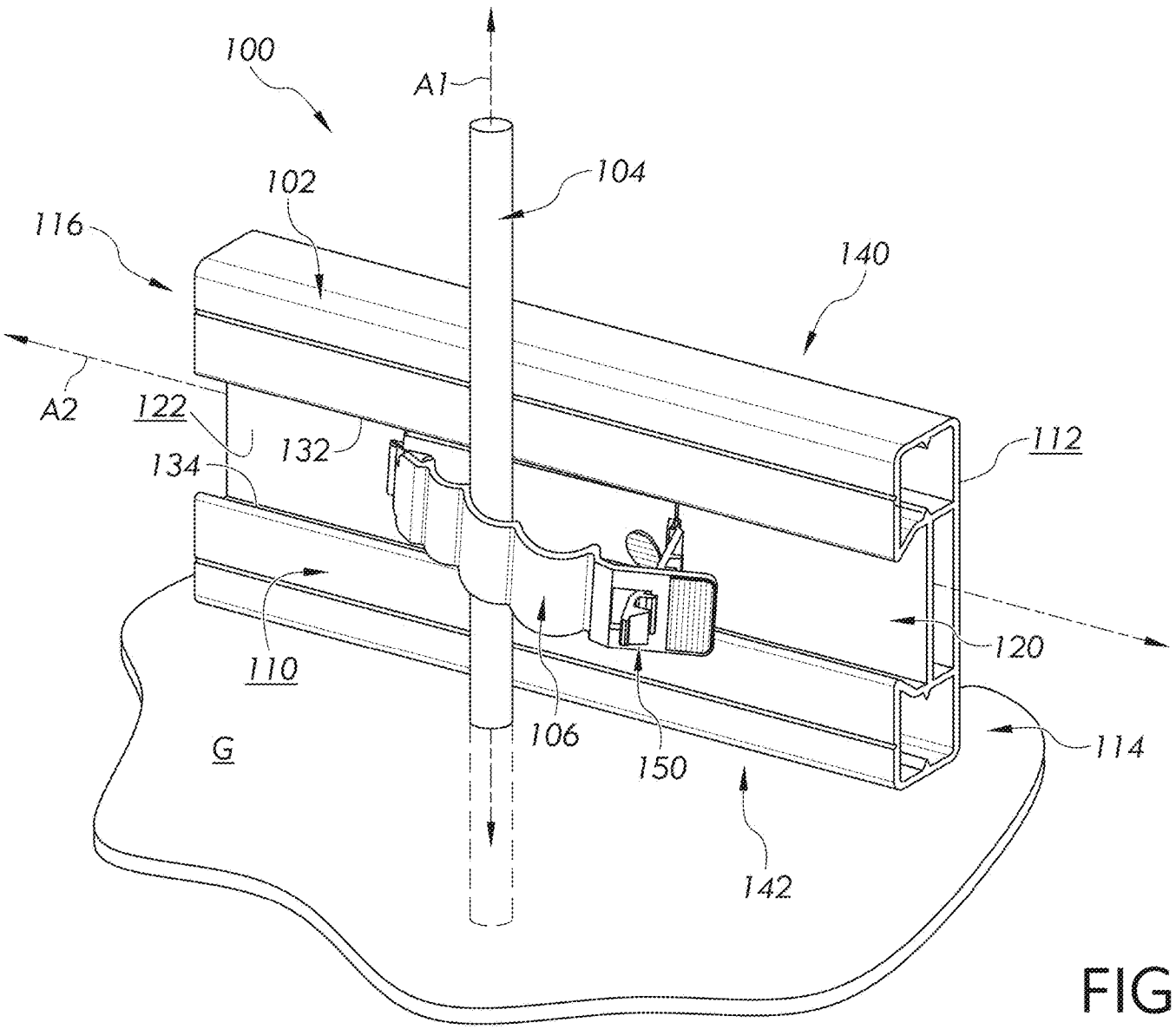
FIG. 1 is a perspective view of a concrete forming system, according to one or more embodiments herein.

Referring initially to FIGS. 1, a concrete forming system 100, (hereinafter, the system 100) may include a form board 102, a stake 104, and a stake clip 106 for securing the form board 102 to the stake 104. While FIG. 1 illustrates just one form board 102 and just one stake 104, more than one form board 102 may be utilized as described below, and more than one stake 104 may be utilized to secure each individual form board 102 as may be desired for a particular application. Also, when in use, the user may hammer the stake 104 into a ground surface G, such that the stake 104 extends in a substantially vertical orientation, with a vertical axis A1 of the stake 104 being substantially perpendicular to the ground surface G.

The form board 102 may include a stake clip facing face 110 and an opposite concrete facing face 112. The concrete facing face 112 may face and contact the poured concrete to be formed during use. Also, the form board 102 may extend along a longitudinal axis A2, between a first end 114 and a second end 116 that may be opposite the first end 114.

The form board 102 may also may include a stake clip receiving groove 120 formed in the stake clip facing face 110. The stake clip receiving groove 120 may extend along the longitudinal axis A2 between the first end 114 and the second end 116. In embodiments, the stake clip receiving groove 120 may be a dovetail groove.

In the illustrated embodiment, the form board 102 may include a groove face 122 that may be vertically oriented such that it may be parallel with the vertical axis A1. The form board 102 may also include an upper lip 132 sloping generally downward from an upper edge 532 of the groove face 122. The form board 102 may further yet include a lower lip 134 sloping generally upward from a lower edge 534 of the groove face 122. As shown in FIG. 1, which respectively illustrate the first end 114 and the second end 116 of the form board 102, the stake clip receiving groove 120 may be defined between the groove face 122, an inner surface of the upper lip 132 which may be generally oriented towards the groove face 122, and an inner surface of the lower lip 134 which may be also generally oriented towards the groove face 122. With this orientation, the stake clip receiving groove 120 may include a width dimension that may be measurable between the groove face 122 and the inner surface if the upper lip 132 and the inner surface if the lower lip 134, and a height dimension that may be measurable between the upper sidewall and the lower sidewall.

In the illustrated embodiment, the inner surfaces may be sloped at an angle relative to the groove face 122 such that the width dimension may be variable and increase or decrease depending on which portion of the inner surfaces between which it may be measured. For example, with reference to the upper lip 132, the width dimension decreases when evaluated at positions relatively closer to an upper side 140 of the form board 102 as compared to a lower side 142 of the form board 102, and, as to the lower lip 134, the width dimension decreases when evaluated at positions relatively closer to a lower side 142 of the form board 102 as compared to a upper side 140 of the form board 102. In embodiments, the width dimension measured between the groove face 122 and the inner surface of the upper lip 132 may be the same as the width dimension measured between the groove face 122 and the inner surface of the lower lip 134, whereas in other embodiments those width dimensions may be different.

Still referring to FIG. 1, and as previously stated, the system 100 may comprise the stake clip 106. As shown in FIG. 1, the stake clip 106 may be configured to be inserted into the stake clip receiving groove 120 of the form board 102 to thereby attach the stake clip 106 to the form board 102. In embodiments, the stake clip receiving groove 120 and/or the stake clip 106 may be/may be configured such that relative movement between the form board 102 and the stake clip 106 may be inhibited when the stake clip 106 may be attached to the form board 102.

Now referring to FIGS. 2-7, illustrated are various view and variations on the stake clip 106. Particularly, as shown in FIGS. 2-7, the stake clip 106 may comprise a form board insertion plate 500, a compression arm 504, a compression arm joint 512, a locking arm 502, and a locking arm joint 510.

Still referring to FIGS. 2-7, and as previously stated, the stake clip 106 may include the form board insertion plate 500, which may itself include a form facing face 408 and an opposite stake facing face 412. The compression arm 504 may itself include a handling face 416, an opposite stake anchoring face 420, and a locking slot 540. As shown at least in FIGS. 2-4, the locking slot 540 may extend through the compression arm 504, i.e. through the handling face 416 and the stake anchoring face 420, at a distal portion of the compression arm 504.

As previously stated, the stake clip 106 may be configured to receive and secure to a stake 104 having various sizes or geometries. For example, and as shown in FIGS. 2-7, the compression arm 504 of the stake clip 106 may comprise at least one stake anchoring position 522/524/526 extending into the stake anchoring face 420, the at least one stake anchoring position sized to receive a stake 104. However, the stake clip 106 may comprise a plurality of the stake anchoring positions, such as a first stake anchoring position 522 sized to receive a stake 104 having a first size, a second stake anchoring position 524 sized to receive a stake 104 having a second size (that may be larger than the first size), and a third stake anchoring position 526 sized to receive a stake 104 having a third size (that may be larger than the first size and the second size). As shown in at least FIGS. 2-4, the handling face 416 may further comprise a plurality of protrusions 523/525/527. The plurality of protrusions may correspond to the plurality of stake anchoring positions 522/524/526, such that the plurality of stake anchoring positions define a plurality of humps on the compression arm 504.

Still referring to FIGS. 2-7, and as previously stated, the stake clip 106 may also comprise the locking arm 502. The locking arm 502 may comprise a locking face 424 and an opposite bumper face 428. As shown in FIGS. 2-7, the locking arm 502 may also comprise a locking tip 432 as well as a plurality of locking projections 542 extending from the locking face 424.

Figure 2:
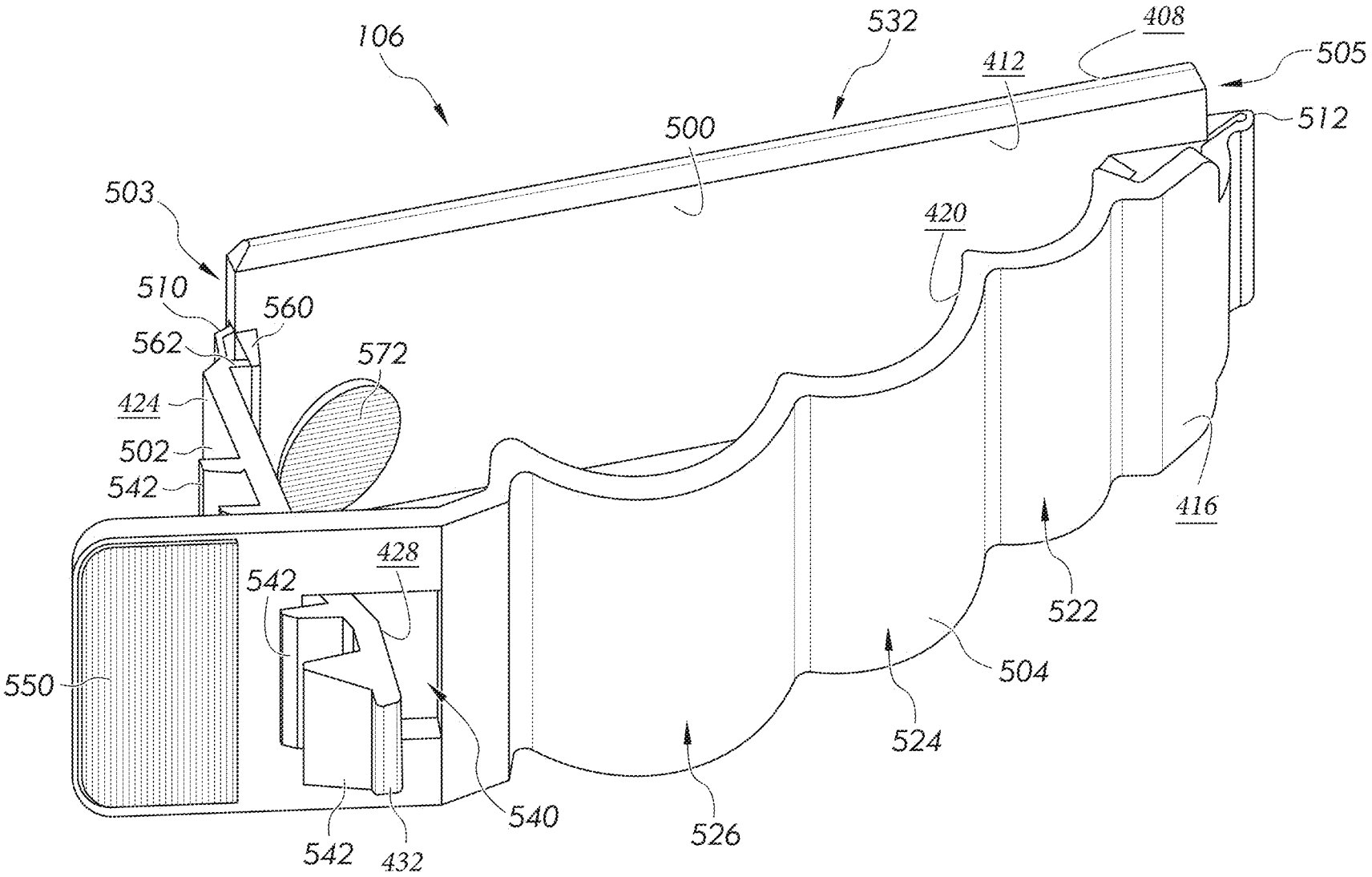
FIG. 2 is a perspective view of a stake clip of the concrete forming system of FIG. 1, according to one or more embodiments herein.
Figure 3:
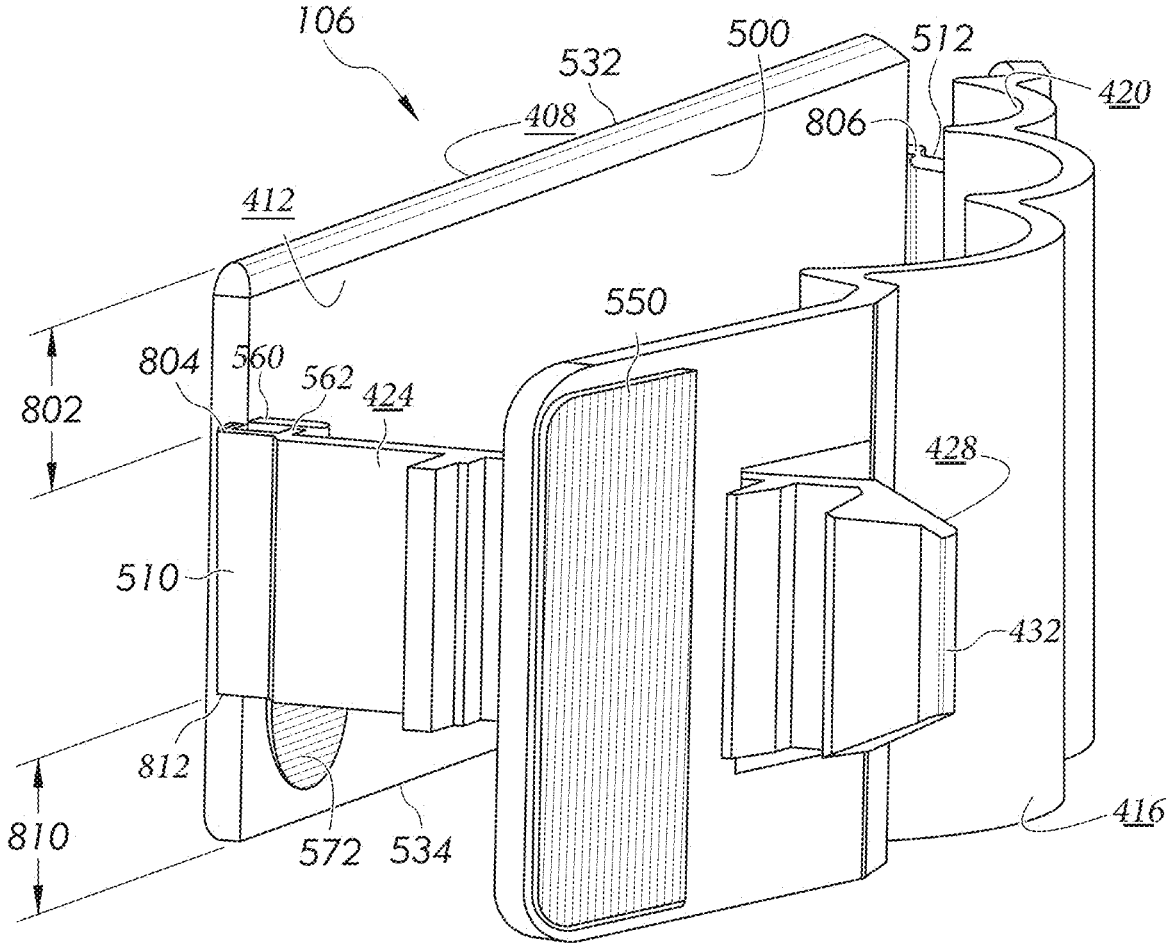
FIG. 3 is another perspective view of the stake clip of FIG. 2, according to embodiments herein.
Figure 4:
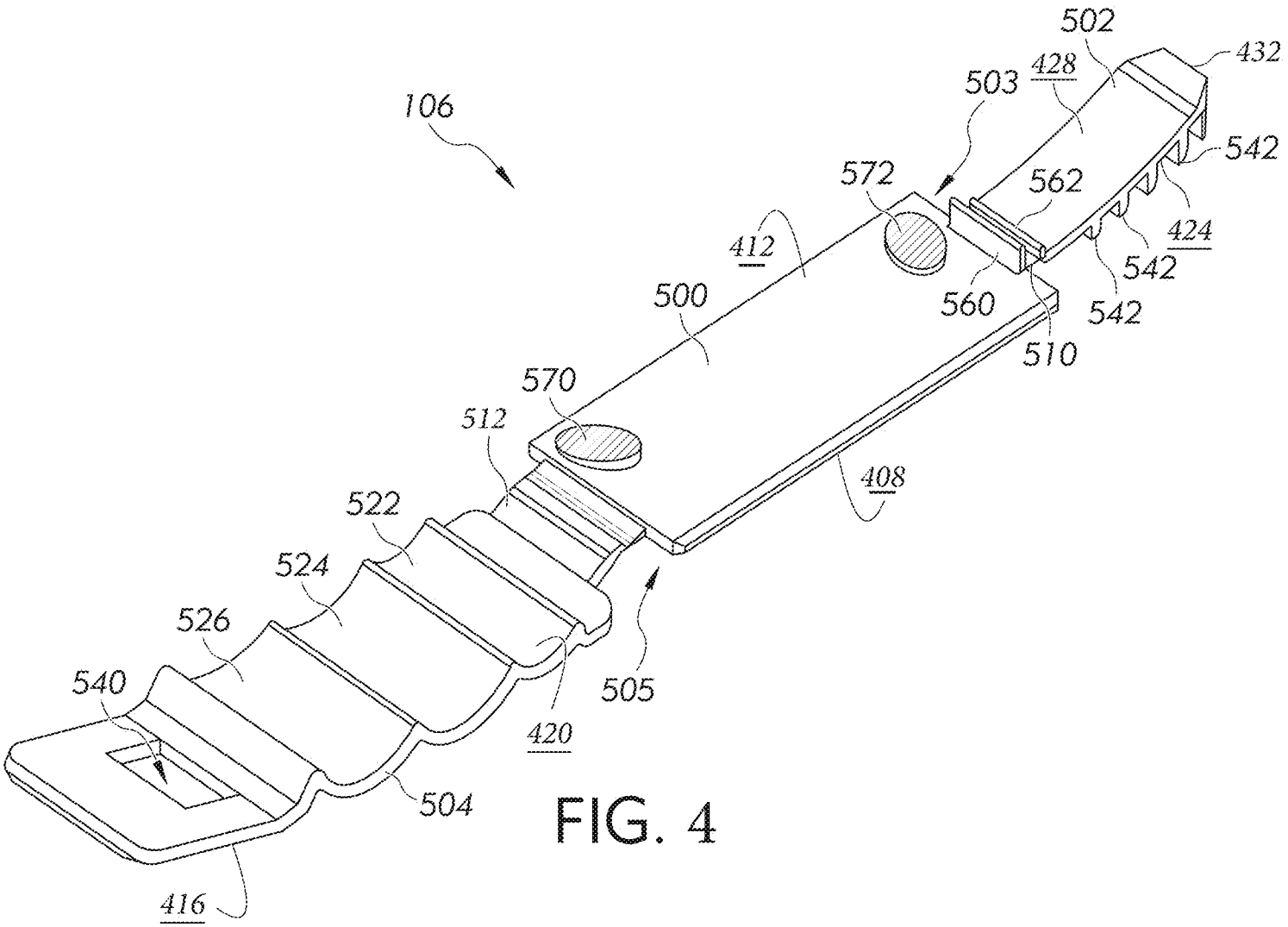
FIG. 4 is a perspective view of the stake clip of FIGS. 1-3 when in an open condition, according to embodiments herein.
Figure 5:
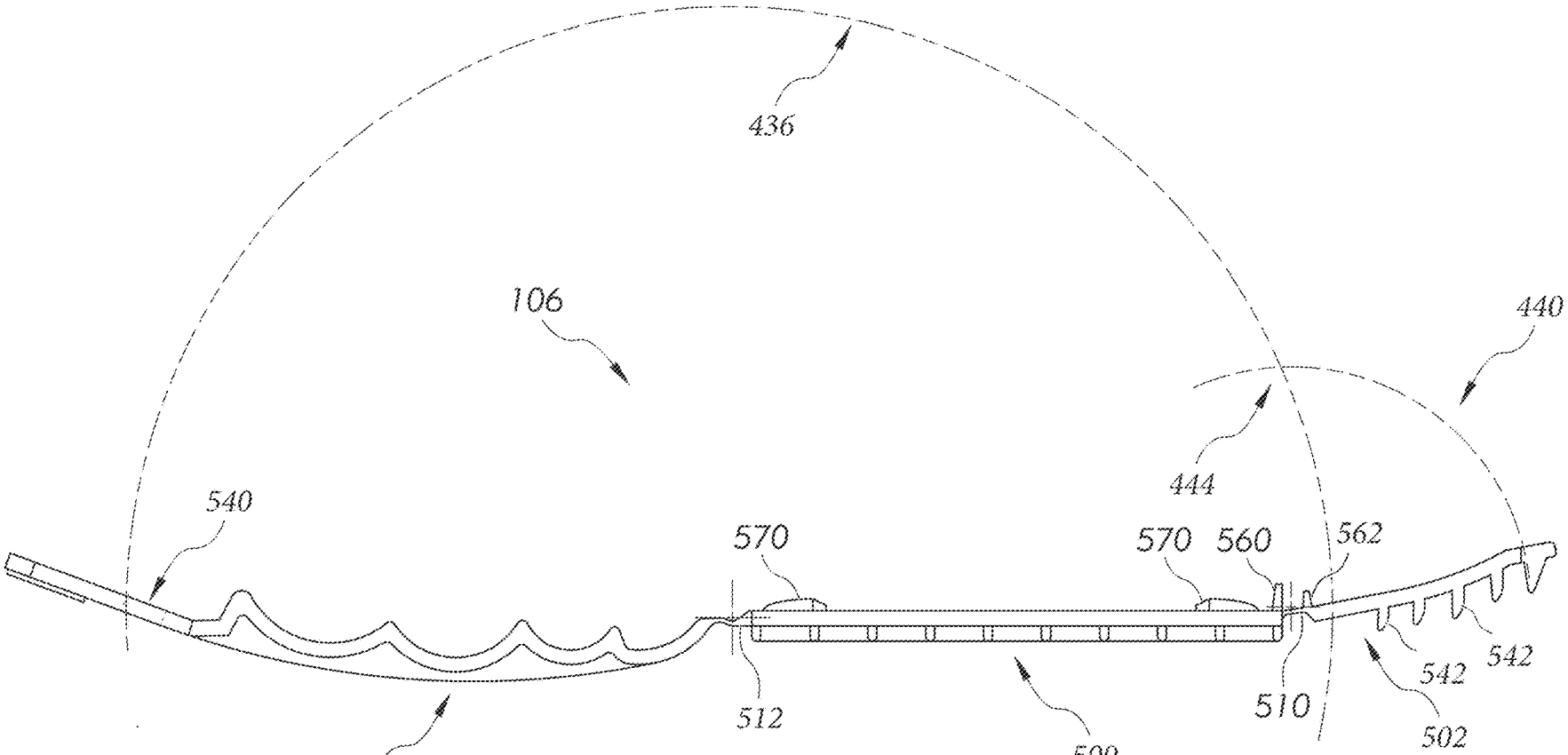
FIG. 5 is an illustration of a stake clip in an open condition, illustrating the at least partially overlapping travel arcs of the arms, according to embodiments herein.
Figure 6:
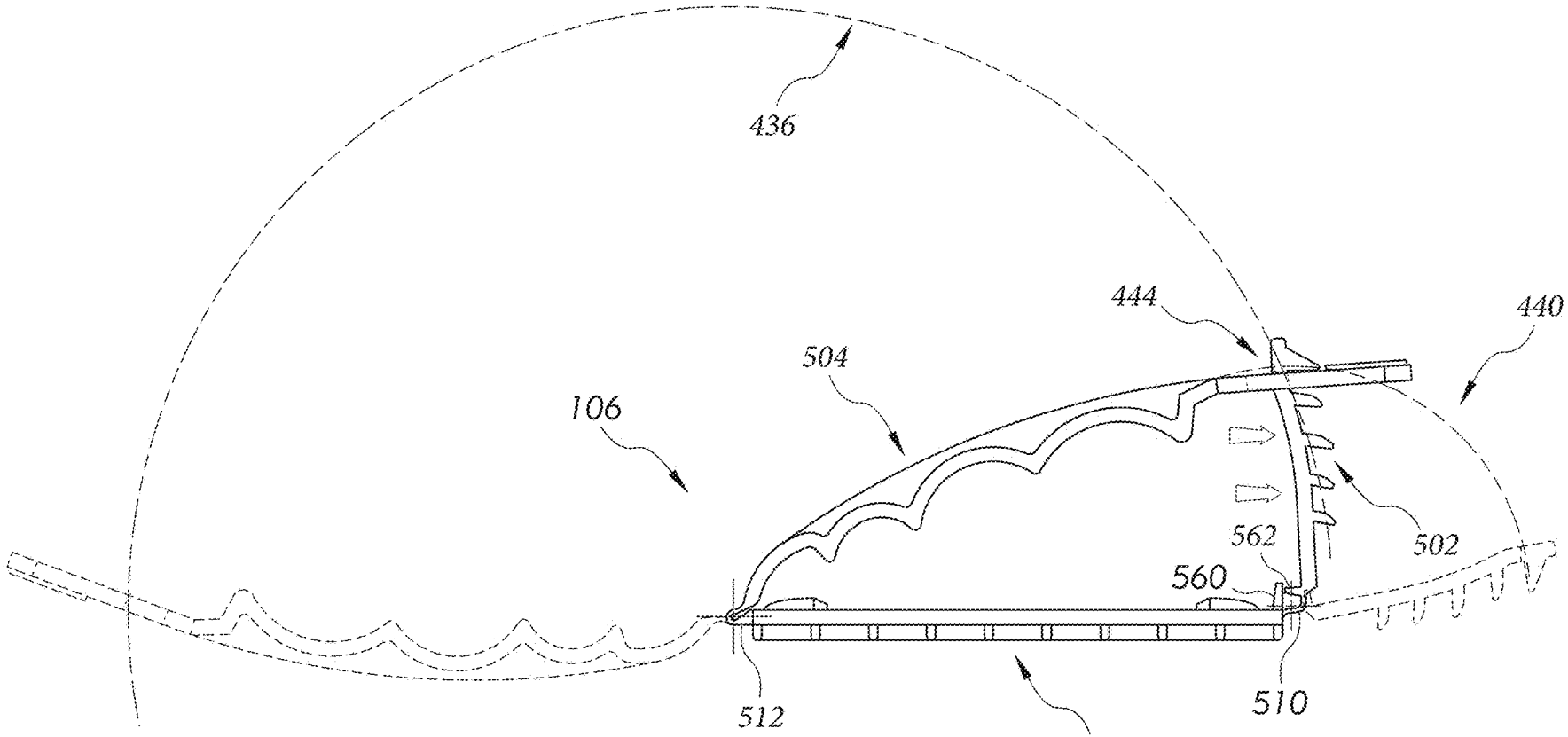
FIG. 6 is an illustration of the stake clip of FIG. 5 transitioning from an open position to a closed position, according to embodiment herein.
Figure 7:
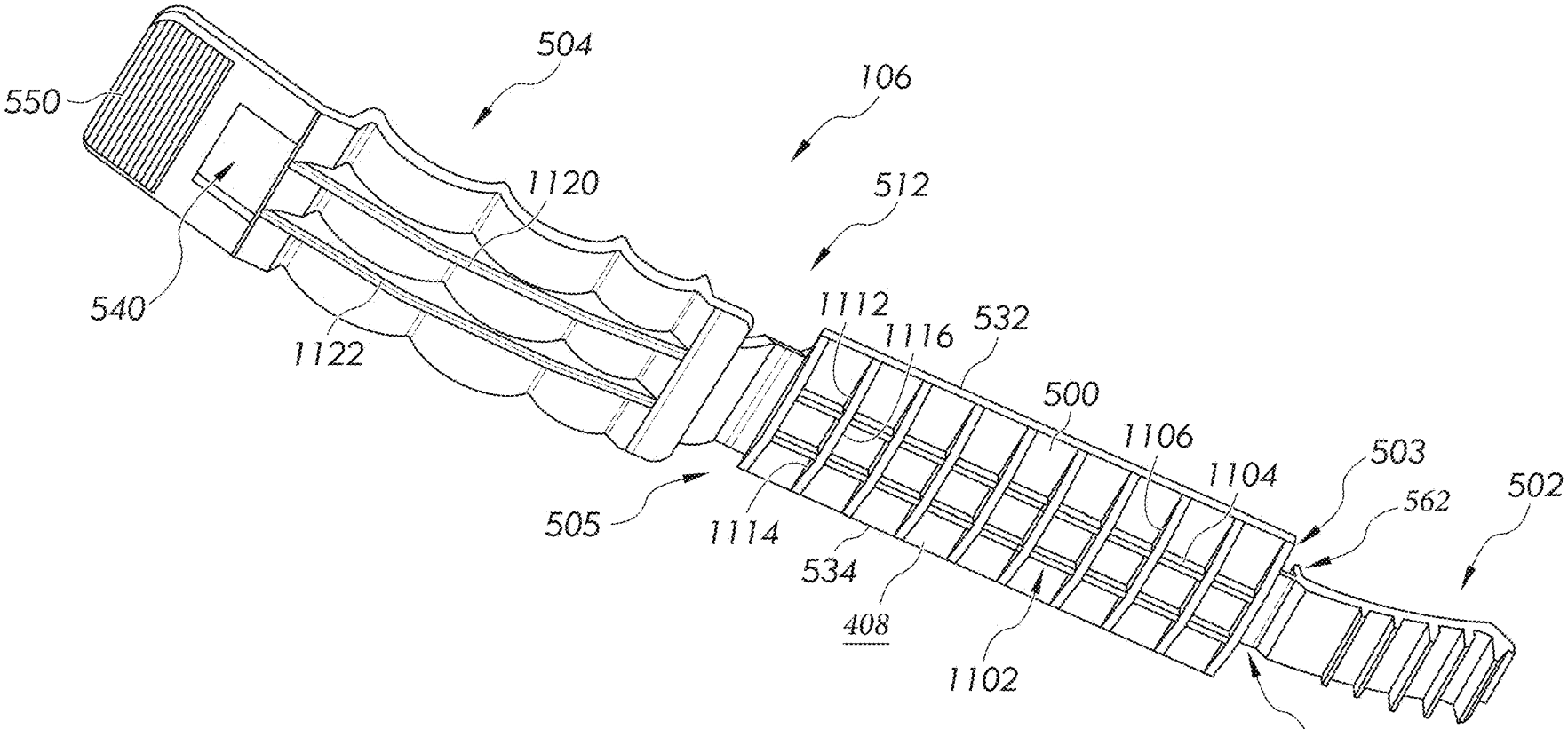
FIG. 7 schematically depicts a variation of the stake clip of FIGS. 1-5, according to embodiments herein.
Figure 8A:
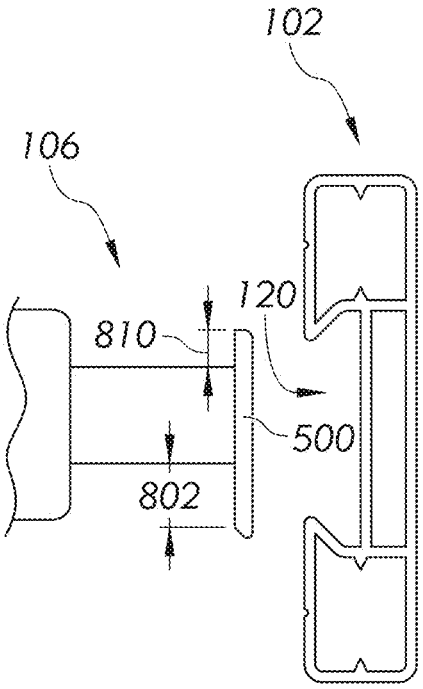
FIG. 8A illustrates a first step in installation of a stake clip into a form board, according to embodiments herein.
Figure 8B:
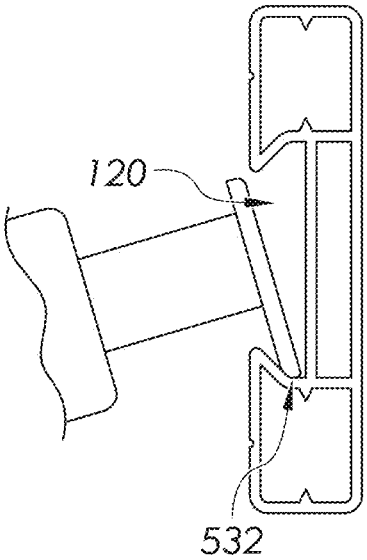
FIG. 8B illustrates a second step in installation of a stake clip into a form board, according to embodiments herein.
Figure 8C:
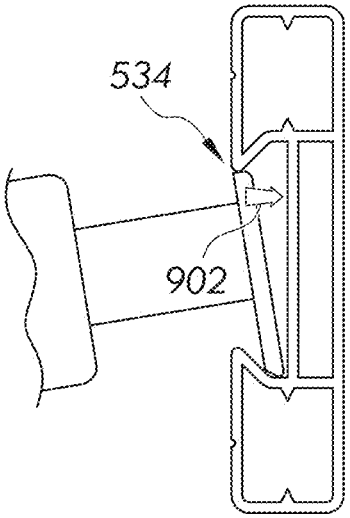
FIG. 8C illustrates a third step in installation of a stake clip into a form board, according to embodiments herein.
Figure 8D:
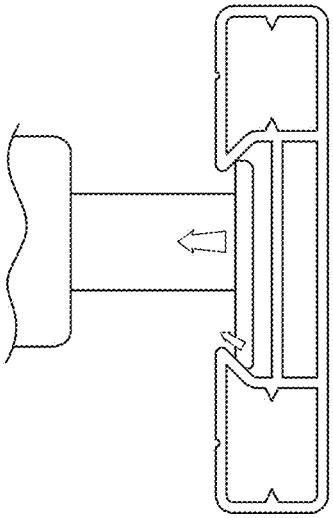
FIG. 8D illustrates a fourth step in installation of a stake clip into a form board, according to embodiments herein.

As shown in FIGS. 1-7, the compression arm 504 and the locking arm 502, through the locking slot 540 and the plurality of locking projections 542 respectively, may together define a locking mechanism 150 that releasably secures the stake clip 106 to the stake 104. For example, FIGS. 1-3 and 6 illustrate the locking mechanism 150 when in a locked/closed condition such that it may be secured to the stake 104. However, as illustrated in FIGS. 4, 5, and 7, the user may manipulate the locking mechanism 150 into an unlocked/opened condition so as to remove the stake clip 106 from the stake 104 or adjust the position of the stake clip 106 on the stake 104. In this manner, the user may lock the locking mechanism 150 to thereby fasten the stake clip 106 to the stake 104 as well as unlock the locking mechanism 150 to thereby detach the stake clip 106 from the stake 104 or adjust positioning of the stake clip 106, as discussed in further detail below.

As also shown in FIGS. 2-7, the stake clip 106 may comprise the locking arm joint 510 and the compression arm joint 512, which may be connected to the form board insertion plate 500. The locking arm joint 510 and the compression arm joint 512 may be spaced apart from each other along a longitudinal dimension of the form board insertion plate 500, such as at a first side 503 of the form board insertion plate 500 for the locking arm joint 510, and at a second side 505 of the form board insertion plate 500 for the compression arm joint 512.

As previously stated, the stake clip 106 may also comprise the locking arm 502 and the compression arm 504, which may be connected at their proximal portions to the form board insertion plate 500 via the locking arm joint 510 and the compression arm joint 512, respectively. Further, the locking arm 502 and the compression arm 504 may be each movable relative to the form board insertion plate 500 via the locking arm joint 510 and the compression arm joint 512, respectively. Particularly, and now referring to FIGS. 5 and 6, the compression arm 504 may be configured to pivot about the compression arm joint 512 through a locking slot travel arc 436. Similarly, the locking arm 502 may be configured to pivot about the locking arm joint 510 through a locking tip travel arc 440.

As also shown in FIGS. 5 and 6, the locking slot travel arc 436 and the locking tip travel arc 440 may overlap at a clip engagement point 444, i.e., the point at which the locking slot 540 of the compression arm 504 initially and the locking tip 432 of the locking arm 502 meet. Moreover, the locking slot travel arc 436 and the locking tip travel arc 440 may further overlap past the clip engagement point 444, thereby enabling the locking tip 432 and at least a portion of the locking arm 502 comprising the locking projections 542 to pass through the locking slot 540 of the compression arm 504, as shown in FIG. 6. Additionally, in at least one embodiment, the locking arm 502, the compression arm 504, or both may have a degree of curvature to case passing of the locking slot 540 through the locking projections 542, as shown for example in FIGS. 5 and 6. Further, a distal portion of the locking arm 502, such as but not limited to the locking tip 432, may be angled or further angled with respect to a remaining portion of the locking arm 502. Similarly, a distal portion of the compression arm 504, such as but not limited to the gripping portion 550, may be angled or further angled with respect to a remaining portion of the compression arm 504.

Still referring to FIGS. 5 and 6, and in embodiments, the locking arm 502 may be spring-biased in a direction of the locking projections 542, shown by the arrows in FIGS. 5 and 6, along a portion of the locking tip travel arc 440 that comprises the clip engagement point 444 and/or the further overlap of the travel arcs, such that the locking slot 540 may be configured to catch on the plurality of locking projections 542 as the compression arm 504 passes through the locking slot 540. In embodiments, the spring biasing of the locking arm 502 may be induced by the material chosen for the locking arm 502 and/or the thickness of the locking arm 502.

Additionally or alternatively, and referring to FIGS. 2-7, the locking arm 502 may further comprise a bumper 562 to provide an additional bias. For example, and in embodiments, the stake facing face 412 of the form board insertion plate 500 may further comprise a locking arm stop 560 that protrudes from the stake facing face 412, such that the locking arm stop 560 is configured to define a maximum pivot angle of the locking arm 502 through the locking tip travel arc 440. The locking arm 502 may further comprise the bumper 562 protruding from the bumper face 428. The bumper 562 may be configured to contact the locking arm stop 560 at the maximum pivot angle of the locking arm 502, and thereby provide an additional bias on the locking arm 502 in the direction of the locking projections 542 when the locking arm stop 560 contacts the bumper 562.

Accordingly, in application, a user may articulate the compression arm 504 of the stake clip 106 into proximity of the locking arm 502 and then insert the locking arm 502 through the locking slot 540 in the compression arm 504 such that one of the locking projections 542 engages the locking slot 540, i.e., the locking slot 540 catches on one of the locking projections 542, to thereby inhibit the compression arm 504 from being released from the locking arm 502. Further, the user may tighten the stake clip 106 by further compressing the compression arm 504 towards the form board insertion plate 500 such that the locking slot 540 engages another of the locking projections 542 that may be positioned closer to the form board insertion plate 500. In embodiments, the compression arm 504 may further include the gripping portion 550 positioned on the distal portion of the compression arm 504 to facilitate the user's ability to press and tighten the locking mechanism 150. To release the locking mechanism 150, or to adjust or untighten the locking mechanism 150 such that may be looser on the stake 104 to thereby allow vertical adjustment of the stake clip 106 thereon, the user may press the locking arm 502 to thereby disengage the locking projection 542 from the locking slot 540, and then fully remove the locking arm 502 from the locking slot 540 of the compression arm 504 or reengage another locking projection 542 that may be relatively further from the form board insertion plate 500 with the locking slot 540 to thereby loosen or untighten the locking mechanism 150. Accordingly, the stake clip 106 may be utilized to securely attach the form board 102 to the stake 104, while allowing for easy vertical adjustment of the form board 102 along the vertical axis A1 of the stake 104 when the stake clip 106 may be attached to the form board 102 and, moreover, the stake clip 106 may be reusable.

As previously stated, the locking projections 542 of the locking arm 502 may be biased into engagement with the locking slot 540 of the compression arm 504. In this manner, the locking mechanism 150 will remain engaged until a user may desire to unlock it, thereby ensuring that the stake clip 106 does not become unintentionally disengaged from the stake 104.

In embodiments, the locking arm stop 560 may be approximately equal in length as the bumper 562. In other embodiments, the locking arm stop 560 may be longer in length than the bumper 562, such that the form board insertion plate 500 is strengthened and instances of the form board insertion plate 500 bending and being pulled out from the stake clip receiving groove 120 of the form board 102 are reduced. Also, the distance that the bumper 562 may extend from the bumper face 428 of the locking arm 502 may be increased in order to provide enhanced or increased resistance against the locking arm stop 560, and thereby allow the stake clip 106 to close more tightly.

In embodiments, the locking arm 502, the compression arm 504, the locking arm joint 510, the compression arm joint 512, or combinations thereof may be integral with the form board insertion plate 500, such that the stake clip 106 may be formed (e.g., molded) from a unitary piece of material. In other embodiments, either or both of the locking arm 502 and/or the compression arm 504 may be not integral with the form board insertion plate 500 but attached to the form board insertion plate 500 such that they may be movable relative to the form board insertion plate 500.

Still referring to FIGS. 2-7, in embodiments, the stake clip 106, as well as the components therein, may be manufactured from plastic, such as a deformable or flexible plastic. In embodiments, the stake clip 106, as well as the components therein, may be formed of materials having varying degrees of stiffness, such that the various components may be configured to have a spring bias towards certain ranges of motion, as explained in further detail hereinbelow. For example, and in embodiments, the locking arm 502 may have a greater degree of stiffness, i.e. may have a greater spring bias, than the compression arm 504. The degree of stiffness may be related to the material chosen for the component and/or the thickness of the component. For example, and in embodiments, the locking arm 502 may have a relatively greater thickness as compared to the compression arm 504 and/or may be made of a different material than the compression arm 504.

As shown in FIGS. 2-7, the at least one stake anchoring position may have a radius of curvature, i.e., a rounded/curved/circular geometry, however, the at least one stake anchoring position may have a width and geometry so as to correspond to stakes having different geometries (e.g., a polygonal or triangular geometry) and/or the stake clip 106 may include one or more additional regions that have the same or different geometries. Also, the stake clip 106 may be formed of a deformable material such that the stake clip 106 may be secured to stakes having geometries that differ than the geometry of the at least one stake anchoring position. The deformable material or deformable plastic may include, but may not be limited to, nylon, polypropylene, or polyethylene.

Still referring to FIGS. 2-7, and as previously described, each of the plurality of stake anchoring positions may have a different, i.e., distinct radius of curvature or width. Particularly, as shown in FIGS. 2-7, the radius of curvature or width of the plurality of stake anchoring positions may increase as a function of distance from the compression arm joint 512, as measured along the compression arm 504. However, in at least some embodiments, each of the plurality of stake anchoring positions may have the same radius of curvature or width.

Referring again to FIGS. 2-4, one or more form board handling panels may be provided on the stake facing face 412 of the form board insertion plate 500. The one or more form board handling panels may comprise a plurality of serrated press points 570, 572 provided a means for the user to engage the stake clip 106 when inserting and pressing the stake clip 106 into the stake clip receiving groove 120 of the form board 102.

Referring now to FIG. 7, an alternate embodiment of the stake clip 106 may be depicted according to one or more embodiments. As shown in FIG. 7, the stake clip 106 may comprise a structural webbing 1102 comprising a plurality of longitudinal ribs 1104, a plurality of lateral ribs 1106, or both. Particularly, the form facing face 408 of the form board insertion plate 500 may comprise the plurality of longitudinal ribs 1104 extending between the first side 503 and the second side 505 of the form board insertion plate 500. The form facing face 408 of the form board insertion plate 500 may also comprise a plurality of lateral ribs 1106 extending between the upper edge 532 and the lower edge 534 of the form board insertion plate 500. In embodiments, and as shown in FIG. 7, the longitudinal ribs 1104 and the lateral ribs 1106 may intersect with each other to define a grid-like-structure.

Also as shown in FIG. 7, at least a portion of the lateral ribs 1106 may be sloped, such that they meet the form facing face 408 at the upper edge 532 and the lower edge 534 of the form board insertion plate 500. For example, each of the lateral ribs 1106 may include a first portion 1112 that slopes towards the form facing face 408 and meets the form facing face 408 at the upper edge 532 and a second portion 1114 that slopes towards the form facing face 408 and meets the form facing face 408 at the lower edge 534. Further, each of the lateral ribs 1106 may include a central portion 1116, extending between the first portion 1112 and the second portion 1114, wherein the first portion 1112 and the second portion 1114 may be sloped towards the central portion 1116 such that they meet the central portion 1116, and with the central portion 1116 extending from the form facing face 408 a distance approximately equal to a distance at which the longitudinal ribs 1104 extend from the form facing face 408.

Also as shown in FIG. 7, one or more lateral ribs 1106 may be provided on the handling face 416 of the compression arm 504. The lateral ribs 1106 may increase rigidity of the compression arm 504 and increase the holding strength of the compression arm 504 when coupled to the locking arm 502, as described herein. The one or more lateral ribs 1106 of the compression may also be similarly curved to those ribs on the form board insertion plate 500.

Now referring to FIGS. 8A-8D, when the stake clip 106 is inserted within the stake clip receiving groove 120 of the form board 102, the stake clip 106 may be secured to the stake clip 106 via the locking mechanism 150 to thereby pull the stake clip facing face 110 of the form board 102 into contact with the stake 104 and to thereby pull the form board insertion plate 500 (e.g., at least the upper edge 532 and the lower edge 534) into contact with the inner surfaces of the stake clip receiving groove 120. In this manner, when installed, the stake clip 106 will be constrained between the form board 102 and the stake 104.

Still referring to FIGS. 8A-8D, the stake clip 106 may be configured to facilitate installation on the form board 102 while inhibiting removal of the stake clip 106 therefrom. For example, and as shown in FIG. 2-3, the form board insertion plate 500 may have a dovetail geometry configured to mate with the dovetail groove geometry of the stake clip receiving groove 120. As shown in FIGS. 2-3, an upper edge 532 of the form board insertion plate 500 may be beveled and a lower edge 534 of the form board insertion plate 500 may be beveled, with the bevel of the upper edge 532 corresponding with the orientation of the inner surface of the upper lip 132 and with the bevel of the lower edge 534 corresponding with the orientation the inner surface of the lower lip 134 of the form board 102.

Further, as shown in FIG. 3, a distance 802 measured between the upper edge 532 of the form board insertion plate 500 and joint upper edges 804, 806 of the locking arm joint 510 and the compression arm joint 512 may be greater (longer) than a distance 810 measured between the lower edge 534 of the form board insertion plate 500 and the lower edges 812 of the locking arm joint 510 and the compression arm joint 512. While FIG. 3 does not illustrate the entirety of the compression arm joint 512, the distance 810 may be similarly measured between the lower edge 534 and a lower edge 534 of the compression arm joint 512 in a similar manner as described with reference to measurement of the distance 810 relative to the lower edge 534 of the locking arm joint 510.

Thus, as shown in FIGS. 8A-8D, when the upper edge 532/lower edge 532/534 is first inserted into the stake clip receiving groove 120, the other of the edges may then be pressed into the stake clip receiving groove 120 as indicated by arrow 902, thereby facilitating insertion and installation of the stake clip 106 with regard to the form board 102, while inhibiting easy removal or dismantling of the stake clip 106 from the form board 102. In embodiments, and as previously stated, the upper edge 532 and/or the lower edge 534 of the form board insertion plate 500 may be beveled or chamfered in order to facilitate insertion of the stake clip 106 into the stake clip receiving groove 120.

Figure 9B:
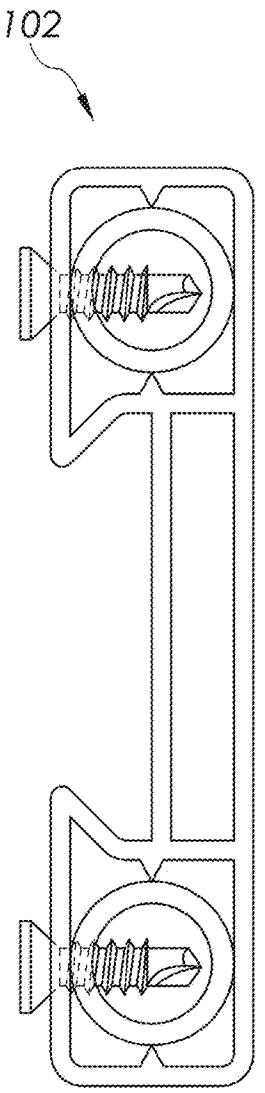
FIG. 9B schematically depicts a means of coupling multiple form boards together, according to embodiments herein.
Figure 9A:
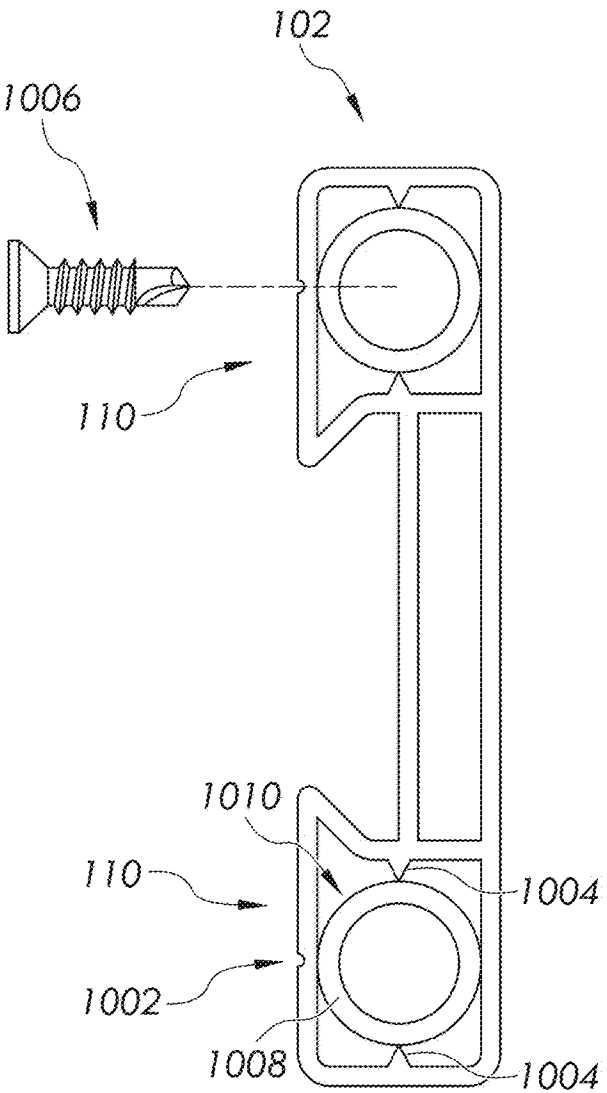
FIG. 9A schematically depicts a means of coupling multiple form boards together, according to embodiments herein.
Figure 10:
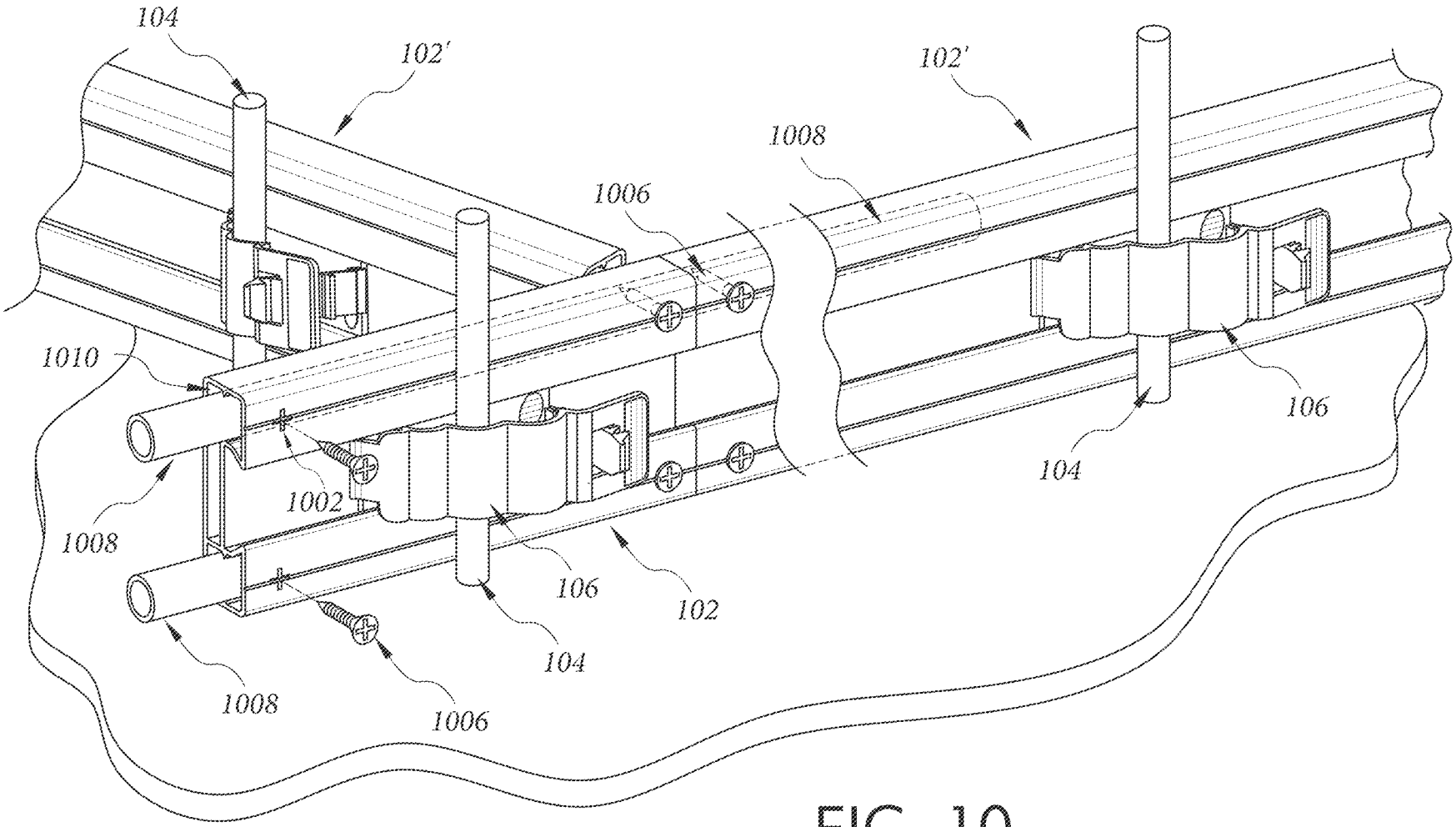
FIG. 10 illustrates a concrete forming system, according to embodiments herein.

As previously mentioned, more than one form board 102 may be utilized in the system 100. FIGS. 9A-10 illustrates a manner of securing more than one form board 102 together, according to one or more embodiments herein. As shown in FIGS. 9A-9B, the form board 102 may include an interior channel 1010 extending along a length of the form board 102, such as from the first end 114 to the second end 116. The interior channel 1010 may also be defined between the stake clip facing face 110 and the opposing concrete facing face 112. The interior channel 1010 may also comprise a plurality of alignment features 1004 protruding from an inner surface of the interior channel 1010. Further, as shown in FIGS. 9A-9B, at least some of the plurality of alignment features 1004 may be opposed to each other, such that a rod 1008 may be aligned within the interior channel 1010.

As also shown in FIGS. 9A-9B, the form board 102 may also comprise one or more screw grooves 1002. The screw groove 1002 may extend into the stake clip facing face 110, such that a screw 1006 may be guided and installed into the screw groove 1002.

To connect neighboring form boards 102 together, the rod 1008 may be inserted into the interior channel 1010 of the form board 102 and aligned/centered by the plurality of alignment features 1004, with the screw 1006 being operable to fasten the rod 1008 to the form board 102. Further, the alignment features 1004 may ensure that the first end of the rod 1008 positioned in the interior channel 1010 of a first form board 102 may be similarly oriented as the second end of the rod 1008 which may be positioned in the interior channel 1010 of a second, neighboring form board 102, thereby ensuring alignment of the first form board 102 and the second, neighboring form board 102. In addition, the alignment features 1004 may create a press-fit connection of the rods 1008 within the interior channel 1010, thereby reducing relative movement of the rods 1008 relative to the form board 102 and further reducing the potential of misalignment.

Now referring to FIG. 10, and as previously stated, the system 100 may comprise more than one form board 102, more than one stake clip, and more than one stake. For example, and as shown in FIG. 10, the system may comprise a first form board 102 and a second form board 102', wherein the first end 114 of a first form board 102 may be aligned with the second end 116 of a second form board 102', such that the stake clip receiving groove 120 and longitudinal axis A2 may be in alignment, and may be then connected together, for example, via the one or more rods, as previously described. As also shown in FIG. 10, at least some of the form boards 102 may be oriented transverse to at least one of the remaining plurality of concrete forms.

It is noted that recitations in the present disclosure of a component of the present disclosure being "operable" or "sufficient" in a particular way, to embody a particular property, or to function in a particular manner, are structural recitations, as opposed to recitations of intended use. More specifically, the references in the present disclosure to the manner in which a component is "operable" or "sufficient" denotes an existing physical condition of the component and, as such, is to be taken as a definite recitation of the structural characteristics of the component.

It is also noted that recitations herein of "at least one" component, element, etc., should not be used to create an inference that the alternative use of the articles "a" or "an" should be limited to a single component, element, etc. The singular forms "a," "an" and "the" include plural referents, unless the context clearly dictates otherwise.

It is noted that one or more of the following claims utilize the term "wherein" as a transitional phrase. For the purposes of defining the present invention, it is noted that this term is introduced in the claims as an open-ended transitional phrase that is used to introduce a recitation of a series of characteristics of the structure and should be interpreted in like manner as the more commonly used open-ended preamble term "comprising." It is noted that the use of the terms "having" or "including", or grammatical variations thereof, in this disclosure should also be interpreted in like manner as the more commonly used open-ended preamble term "comprising".

As used in this disclosure, terms such as "first" and "second" are arbitrarily assigned and are merely intended to differentiate between two or more instances or components. It is to be understood that the words "first" and "second" serve no other purpose and are not part of the name or description of the component, nor do they necessarily define a relative location, position, or order of the component. Furthermore, it is to be understood that the mere use of the term "first" and "second" does not require that there be any "third" component, although that possibility is contemplated under the scope of the present disclosure.

Having described the subject matter of the present disclosure in detail and by reference to specific embodiments thereof, it may be noted that the various details disclosed herein should not be taken to imply that these details relate to elements that may be essential components of the various embodiments described herein, even in cases where a particular element may be illustrated in each of the drawings that accompany the present description. Further, it will be apparent that modifications and variations may be possible without departing from the scope of the present disclosure, including, but not limited to, embodiments defined in the appended claims. More specifically, although some aspects of the present disclosure may be identified herein as preferred or particularly advantageous, it may be contemplated that the present disclosure may be not necessarily limited to these aspects.

What is claimed is:

1. A stake clip comprising:

a form board insertion plate comprising a form facing face and an opposite stake facing face;

a compression arm comprising a handling face, an opposite stake anchoring face, and a locking slot extending through the compression arm at a distal portion of the compression arm, wherein the stake anchoring face comprises at least one stake anchoring position extending into the stake anchoring face;

a compression arm joint connecting a proximal portion of the compression arm to the form board insertion plate, the compression arm configured to pivot about the compression arm joint through a locking slot travel arc;

a locking arm comprising a locking face, a locking tip, and a plurality of locking projections extending from the locking face; and a locking arm joint connecting a proximal portion of the locking arm to the form board insertion plate, the locking arm configured to pivot about the locking arm joint through a locking tip travel arc, and wherein:

the locking arm joint and the compression arm joint are spaced apart from each other along a longitudinal dimension of the form board insertion plate, the locking slot travel arc of the compression arm and the locking tip travel arc of the locking arm overlap at a clip engagement point to enable the locking tip and a portion of the locking arm comprising the locking projections to pass through the locking slot of the compression arm, and the locking arm is spring-biased in a direction of the locking projections along a portion of the locking tip travel arc that comprises the clip engagement point, such that the locking slot is configured to catch on the plurality of locking projections as the locking arm passes through the locking slot.

2. The stake clip of claim 1, wherein the stake anchoring face comprises a plurality of stake anchoring positions.

3. The stake clip of claim 2, wherein each of the plurality of stake anchoring positions comprises a distinct radius of curvature or a distinct width.

4. The stake clip of claim 3, wherein the radius of curvature or the width of the stake anchoring positions increases as a function of distance from the compression arm joint measured along the compression arm.

5. The stake clip of claim 2, wherein the handling face of the compression arm comprises a plurality of protrusions corresponding to the plurality of stake anchoring positions in the stake anchoring face, such that the plurality of stake anchoring positions define a plurality of humps on the compression arm.

6. The stake clip of claim 1, wherein:

the stake facing face of the form board insertion plate further comprises a locking arm stop that protrudes from the stake facing face; and the locking arm stop is configured to define a maximum pivot angle of the locking arm through the locking tip travel arc.

7. The stake clip of claim 6, wherein:

the locking arm further comprises a bumper face opposite the locking face and a bumper that protrudes from the bumper face;

the bumper is configured to contact the locking arm stop at the maximum pivot angle of the locking arm; and the bumper is configured to provide an additional bias on the locking arm in the direction of the locking projections when the locking arm stop contacts the bumper.

8. The stake clip of claim 1, wherein at least the handling face of the compression arm further comprises a gripping portion positioned on the distal portion of the compression arm.

9. The stake clip of claim 1, wherein:

a distal portion of the locking arm is angled with respect to a remaining portion of the locking arm;

the distal portion of the compression arm is angled with respect to a remaining portion of the compression arm; or both.

10. The stake clip of claim 1, wherein the stake facing face of the form board insertion plate further comprises one or more form board handling panels, each of the one or more form board handling panels comprising a plurality of serrated press points.

11. The stake clip of claim 1, wherein:

a height of the compression arm joint, measured from upper and lower edges of the compression arm joint, is of a lesser height than a height of the form board insertion plate measured from upper and lower edges of the form board insertion plate; and a height of the locking arm joint, measured from upper and lower edges of the locking arm joint, is of a lesser height than the height of the form board insertion plate.

12. The stake clip of claim 11, wherein:

a distance of the upper edge of the compression arm joint from the upper edge of the form board insertion plate is different from a distance of the bottom edge of the compression arm joint from the bottom edge of the form board insertion plate;

a distance of the upper edge of the locking arm joint from the upper edge of the form board insertion plate is different from a distance of the bottom edge of the locking arm from the bottom edge of the form board insertion plate; or both.

13. The stake clip of claim 1, wherein:

the form facing face of the form board insertion plate comprise a structural webbing comprising a plurality of longitudinal and lateral ribs;

the handling face of the compression arm comprises a plurality of longitudinal ribs; or both.

14. The stake clip of claim 1, wherein the compression arm, the compression arm joint, the locking arm, and the locking arm joint are formed of a deformable material.

15. A form board utilizing the stake clip of claim 1, the form board comprising:

the stake clip of claim 1; and a form board engaged with the stake clip of claim 1, the form board comprising a stake clip facing face and an opposite concrete facing face, the stake clip facing face comprising a stake clip receiving groove for receiving the form board insertion plate of the stake clip.

16. The form board of claim 15, further comprising a stake engaged with the stake facing face of the form board insertion plate and the stake anchoring position of the stake clip.

17. The form board of claim 15, wherein:

the stake clip receiving groove is a dovetail groove; and the form board insertion plate comprises a dovetail geometry configured to fit in the dovetail groove of the stake clip receiving groove.

18. A concrete forming system utilizing a plurality of the form boards of claim 15.

19. A stake clip comprising:

a form board insertion plate comprising a form facing face, an opposite stake facing face, and a locking arm stop that protrudes from the stake facing face;

a compression arm comprising a handling face, an opposite stake anchoring face, and a locking slot extending through the compression arm at a distal portion of the compression arm, wherein the stake anchoring face comprises a plurality of stake anchoring positions (522/524/526) extending into the stake anchoring face and a plurality of protrusions corresponding to the plurality of stake anchoring positions, each of the plurality of stake anchoring positions comprising a distinct radius of curvature;

a compression arm joint connecting a proximal portion of the compression arm to the form board insertion plate, the compression arm configured to pivot about the compression arm joint through a locking slot travel arc, and wherein the radius of curvature of the stake anchoring positions increases as a function of distance from the compression arm joint measured along the compression arm;

a locking arm comprising a locking face, an opposite bumper face, a bumper protruding from the bumper face, a locking tip, and a plurality of locking projections (542) extending from the locking face; and a locking arm joint connecting a proximal portion of the locking arm to the form board insertion plate, the locking arm configured to pivot about the locking arm joint through a locking tip travel arc, the locking arm stop defining a maximum pivot angle of the locking arm through the locking tip travel arc, and wherein:

the locking arm joint and the compression arm joint are spaced apart from each other along a longitudinal dimension of the form board insertion plate, the locking slot travel arc of the compression arm and the locking tip travel arc of the locking arm overlap at a clip engagement point to enable the locking tip and a portion of the locking arm comprising the locking projections to pass through the locking slot of the compression arm, the locking arm is spring-biased in a direction of the locking projections along a portion of the locking tip travel arc that comprises the clip engagement point, such that the locking slot is configured to catch on the plurality of locking projections as the compression arm passes through the locking slot, the bumper is configured to contact the locking arm stop at the maximum pivot angle of the locking arm, and the bumper is configured to provide an additional bias on the locking arm in the direction of the locking projections when the locking arm stop contacts the bumper.

20. A stake clip comprising:

a form board insertion plate;

a compression arm comprising at least one stake anchoring position and a locking slot extending through the compression arm;

a compression arm joint connecting the compression arm to the form board insertion plate, the compression arm configured to pivot about the compression arm joint through a locking slot travel arc;

a locking arm comprising a locking tip and a plurality of locking projections; and a locking arm joint connecting the locking arm to the form board insertion plate, the locking arm configured to pivot about the locking arm joint through a locking tip travel arc, and wherein:

the locking slot travel arc of the compression arm and the locking tip travel arc of the locking arm overlap at a clip engagement point, and the locking arm is spring-biased in a direction of the locking projections, such that the locking slot is configured to catch on the plurality of locking projections as the locking arm passes through the locking slot.

* * * * *